United States Patent [19]

McDonald et al.

[11] Patent Number: 4,819,613

[45] Date of Patent: Apr. 11, 1989

[54] INLET VENTS FOR FIREPLACES

[76] Inventors: Brian A. McDonald, 97 Burnaby Boulevard, Toronto, Ontario, Canada, M5N 1G3; Kaye Baldwin, 6 Forest Laneway, Apt. 2806, Willowdale, Ontario, Canada

[21] Appl. No.: 173,143

[22] Filed: Mar. 25, 1988

[51] Int. Cl.[4] ..... F24B 13/02

[52] U.S. Cl. ..... 126/515; 126/242

[58] Field of Search ..... 126/143, 242, 140, 243–245, 126/120, 121, 112, 85 B, 288, 285 R, 139, 140; 98/36, 59, 103; 237/51, 46

[56] References Cited

U.S. PATENT DOCUMENTS

| | | | |
|---|---|---|---|
| 2,375,318 | 5/1945 | Mudgett | 126/143 |
| 2,740,398 | 4/1956 | Collins | 126/143 |
| 4,106,475 | 8/1978 | Mayes | 126/121 |
| 4,173,967 | 11/1979 | Brown | 126/143 |
| 4,266,525 | 5/1981 | Hall | 126/121 |
| 4,374,515 | 2/1983 | Conrad | 126/143 |
| 4,399,806 | 8/1983 | Love | 126/242 |
| 4,471,756 | 9/1984 | Eberhardt | 126/143 |
| 4,574,772 | 3/1986 | Nagel | 126/143 |

FOREIGN PATENT DOCUMENTS

| | | | |
|---|---|---|---|
| 744169 | 2/1956 | United Kingdom | 126/143 |

*Primary Examiner*—James C. Yeung
*Attorney, Agent, or Firm*—Ridout & Maybee

[57] ABSTRACT

A fresh air vent for building into the hearth of a fireplace is constructed with the shape and heft of a hearth brick. It has a body and lid of heavy-gauge steel, the body replacing a hearth brick in the hearth, and defining a screened top opening to a tubular flange extending most of the depth of the vent so as to establish a secure connection to an air duct without the use of tools. The lid is hinged to the back of the body, and has slightly inclined end walls passing through and retained in slots in the top of the body to establish frictional engagement therewith when the lid is open.

3 Claims, 2 Drawing Sheets

FIG. 2
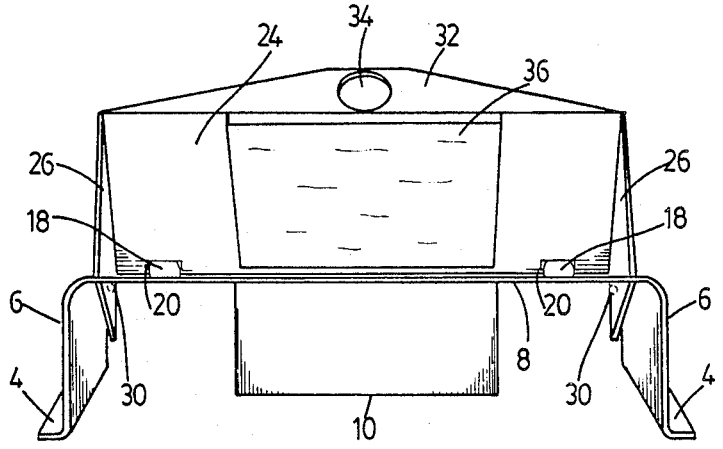
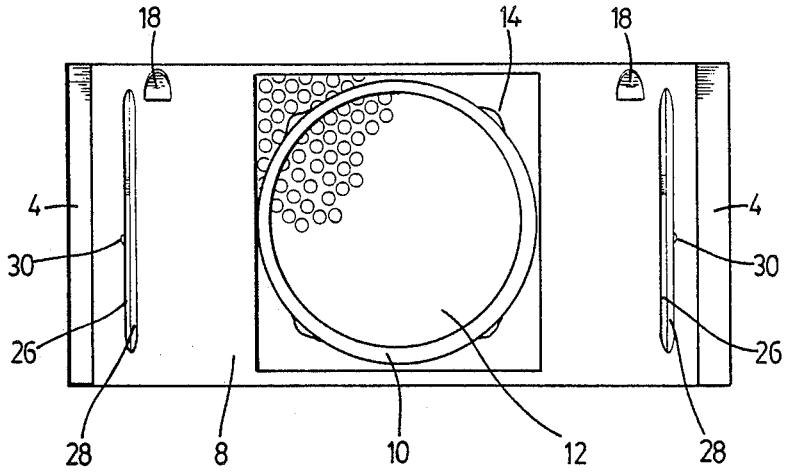
FIG. 3

INLET VENTS FOR FIREPLACES

BACKGROUND OF THE INVENTION

1. FIELD OF THE INVENTION

It has long been considered advantageous in many instances to provide built-in fireplaces with an external source of combustion air. With improved draft sealing of modern houses, the absence of such a source can give rise to a hazard since air drawn from a house by a fireplace can give rise to a negative pressure differential within the house which can interfere with the proper operation of other combustion apparatus such as furnaces. This has given rise to regulatory requirements in certain jurisdictions for the provision in new construction of fresh air inlets for fireplaces, which inlets have to comply with certain requirements, e.g. the air opening must face away from the grate and be provided with a screen. The screen minimizes the risk of cinders or coals falling into the opening, which could constitute a hazard if they block, burn or overheat the air ducting connected to the vent opening. Such ducting is typically of light gauge aluminum, and is unsuited to protecting surrounding structures from excessive temperatures.

Fresh air vents must usually be installed during construction of the fireplace, which is typically carried out by a bricklayer or stonemason. Typical vents are fabricated from light gauge galvanized steel similar to that used for central heating ducting. Their handling and connection to the associated air ducting requires skills different from those of the average bricklayer, as well as tools not found in the customary bricklayer's tool-kit. Even the finished installation will be subject to quite rough handling, being typically located in the floor of the hearth just in front of the grate.

SUMMARY OF THE INVENTION

The present invention seeks to provide a fresh air vent for fireplaces which is better suited for handling and installation by a bricklayer utilizing the tools customary in that trade, which can be manufactured in a simple manner, which is very strong, and which is easy to operate when in use, and gives a solid "feel".

According to the invention, a fresh air vent for installation in the hearth of a fireplace comprises a body having a flat rectangular top wall, opposite vertical walls descending from two opposite sides of the top, and flanges out-turned from the bottoms of the vertical walls, the body less the flanges having the dimensions of a hearth brick, the top wall defining a central opening and having a screen located in the opening, and further defining two slots adjacent and parallel to the vertical walls; a tubular flange extending downwardly from the top wall beneath the periphery of the opening for substantially the full height of the body, the tubular flange being sized to accept the end of a cylindrical air duct as a push fit; a lid member having a flat, rectangular top wall slightly smaller than the top wall of the body, a rear edge of the lid member being typically connected to the top wall of the body adjacent a rear edge of the latter, and depending side walls at each end extending through the slot in the top wall of the body; each side wall being slightly laterally inclined to the vertical so as frictionally to engage sides of the slots upon upward movement of the lid about its hinged connection, and provided with a stop means to prevent its complete withdrawal from the associated slot; and an upturned flange provided on a front edge of the lid member, the flange having means to provide a purchase for a tool, used to lift the lid; the body and lid being formed of sheet steel of a gauge sufficient to provide the vent with a heft similar to that of a hearth brick. Preferably the means to provide a purchase is a hole defined in the flange, and of a size to accept the end of a poker.

SHORT DESCRIPTION OF THE DRAWINGS

In the drawings:

FIG. 2 is a front elevation of the vent;

FIG. 3 is a bottom plan view of the vent; and

DESCRIPTION OF THE PREFERRED EMBODIMENT

Figure 1:
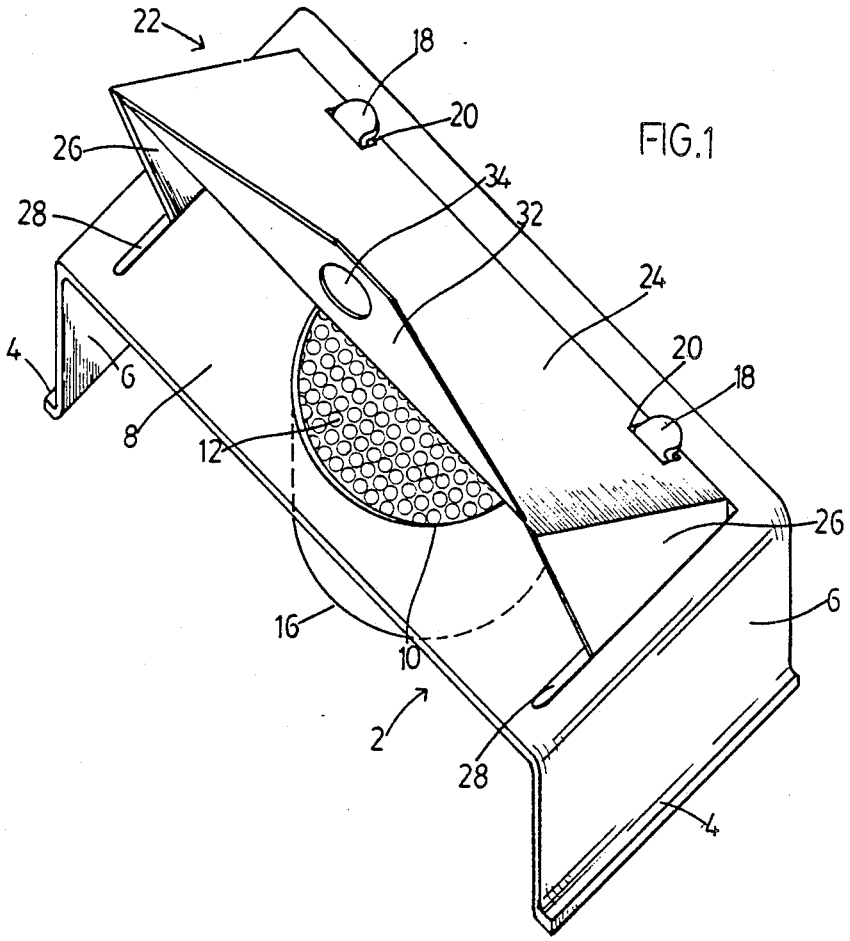
FIG. 1 is a perspective view of a preferred embodiment of a vent in accordance with the invention, from in front, one side and above, with the lid open.
Figure 4:
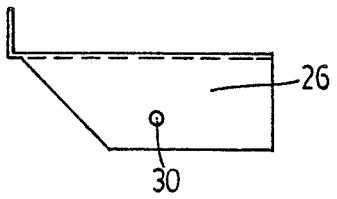
FIG. 4 is an end view of the lid.

Referring to the drawings, a fresh air vent for a fireplace has a body 2 dimensioned to have a depth, height and length (less that of flanges 4) similar to that of a hearth brick so that the vent may be used in place of such a brick when building the hearth of a fireplace. The flanges 4 provide additional anchorage for the unit in the hearth, being out-turned from vertical end walls 6 of the body 2. These walls depend from a rectangular, flat top wall 8 of the body to provide the latter with the depth of a hearth brick, whilst the top wall 8 provides the length and width. A central, circular opening 10 is provided in the top wall, and is provided with a screen 12 formed by a square of perforated steel which is secured beneath the opening 10 by welds 14, which welds also secure a tubular flange 16. Other constructions are possible; for example, the flange 16 could be pressed from the body and a circular screen secured over or within the opening 10, or a screen could be formed by perforating or slotting the top 8. A separate screen 12 is preferred, since it permits changes to the screen to be made to meet local regulations without changes in tooling. The flange 16 depends almost the full depth of the unit and is dimensioned to receive air duct tubing as a push fit; this enables a secure connection without the use of tools.

Two rearwardly bent ears 18 are struck up from adjacent the rear edge of the top wall 8, and engage slots 20 adjacent the rear edge of a lid 22 so as to secure the latter in a hinged relationship to the body. The lid has a rectangular top wall 24 of slightly smaller dimensions than those of the top wall of the body, and has depending side walls 26 which pass through slots 28 in the top wall 8 extending adjacent and parallel to the side walls 6. The walls 26 are inclined slightly outwards so as resiliently to engage the outer edges of the slots 28 as the lid 22 is lifted. Complete withdrawal of the walls 26 from the slots is prevented by dimples 30 punched in the walls 28. The lid 22 has an upturned flange 32 at its front edge which is provided with a hole 34 to receive the end of a fire iron such as a poker used to lift the lid to its open position shown in FIG. 1. A fireproof gasket 36 is secured beneath the lid so as to seal the opening 10 when the lid is lowered.

The body and lid are formed of heavy gauge steel sheet, selected to provide the vent with a heft comparable to that of a hearth brick. This not only makes the vent comfortable for a bricklayer to work with, but ensures adequate robustness of the unit to withstand the handling which may be expected during installation and subsequent use. It also provides the vent when in use with a solid quality "feel", and provides the lid 22 with adequate rigidity to ensure that frictional engagement between the walls 26 and the slots 28 will reliably hold the lid in the open position even after prolonged use.

Variations in the lid construction are possible; for example, different hinge arrangement may be utilized, or the flange 32 can be formed with a forwardly turned upper edge to provide a purchase for a poker in place of the preferred arrangement using the hole 34.

We claim:

1. A fresh air vent for installation in the hearth of a fireplace comprising:

a body having a flat, rectangular top wall, opposite vertical walls descending from two opposite sides of the top, flanges out-turned from the bottoms of the vertical walls, the body less the flanges having the dimensions of a hearth brick, the top wall defining a central opening and having a screen located in the opening, and further defining two slots adjacent and parallel to the vertical walls;

a tubular flange extending downwardly from the top wall beneath the periphery of the opening for substantially the full height of the body, the tubular flange being sized to accept the end of a cylindrical air duct as a push fit;

a lid member having a flat., rectangular top wall slightly smaller than the top wall of the body, a rear edge of the lid member being hingedly connected to the top wall of the body adjacent a rear edge of the latter and depending side walls at each end extending through the slot in the top wall of the body;

each side wall being slightly laterally inclined to the vertical so as frictionally to engage sides of the slots upon upward movement of the lid about its hinged connection, and provided with a stop means to prevent its complete withdrawal from the associated slot;

and an upturned flange provided on a front edge of the lid member, the flange being means to provide a purchase for a tool used to lift the lid;

the body and lid being formed of sheet steel of a gauge sufficient to provide the vent with a heft similar to that of a hearth brick.

2. A fresh air vent according to claim 1., wherein the means to provide purchase is a hole defined in the flange at the front edge of the lid.

3. A fresh air vent according to claim 1, wherein the lid is hingedly connected to the body by ears struck up from the body, and passing through slots in the lid.

* * * * *